United States Patent [19]

Kawata et al.

[11] Patent Number: 4,640,892

[45] Date of Patent: Feb. 3, 1987

[54] HEAT-DEVELOPABLE LIGHT-SENSITIVE MATERIAL

[75] Inventors: Ken Kawata; Yoshiharu Yabuki; Kozo Sato; Hiroyuki Hirai, all of Kanagawa, Japan

[73] Assignee: Fuji Photo Film Co., Ltd., Kanagawa, Japan

[21] Appl. No.: 769,275

[22] Filed: Aug. 26, 1985

[30] Foreign Application Priority Data

Aug. 24, 1984 [JP] Japan ..... 59-176401

[51] Int. Cl.[4] ..... G03C 1/02

[52] U.S. Cl. ..... 430/617; 430/607; 430/613; 430/614; 430/619; 430/620; 430/351; 430/353; 430/151; 430/171; 430/203; 430/559; 430/562; 430/543; 430/955

[58] Field of Search ..... 430/351, 353, 617, 619, 430/620, 151, 179, 955, 171, 177, 607, 203, 559, 562, 543, 613, 614

[56] References Cited

U.S. PATENT DOCUMENTS

| | | | |
|---|---|---|---|
| 3,220,846 | 11/1965 | Tinker et al. | 430/349 |
| 4,487,826 | 12/1984 | Watanabe et al. | 430/178 |
| 4,499,180 | 2/1985 | Hirai et al. | 430/559 |

FOREIGN PATENT DOCUMENTS

| | | | |
|---|---|---|---|
| 909491 | 10/1962 | United Kingdom | 430/151 |

*Primary Examiner*—Won H. Louie

*Attorney, Agent, or Firm*—Sughrue, Mion, Zinn, Macpeak, and Seas

[57] ABSTRACT

A heat-developable color photographic light-sensitive material comprises a support having thereon at least one layer containing the novel base precursor. This heat-developable color photographic light-sensitive material provides a high maximum density and low fog by heat-developing at a relatively low temperature and for a short period of time.

5 Claims, No Drawings

HEAT-DEVELOPABLE LIGHT-SENSITIVE MATERIAL

FIELD OF THE INVENTION

The present invention relates to a heat-developable light-sensitive material containing a base precursor.

BACKGROUND OF THE INVENTION

Heat-developable light-sensitive materials often contain a base or a base precursor in order to accelerate heat development. Further, it is preferred to use a base precursor releasing a base by thermal decomposition in order to obtain good storage stability of the light-sensitive material.

Typical examples of base precursors are described in British Pat. No. 998,949. A preferred base precursor is a salt of a carboxylic acid and an organic base. Useful carboxylic acids include trichloroacetic acid and trifluoroacetic acid. Useful bases include guanidine, piperidine, morpholine, p-toluidine and 2-picoline. The guanidinetrichloroacetic acid described in U.S. Pat. No. 3,220,846 is particularly useful. Aldoneamides as described in Japanese Patent Application (OPI) No. 22625/75 are decomposed to generate bases at a high temperature and are preferably used.

However, light-sensitive materials containing such base precursors often require a relatively long time to produce an image, or have high fog. Moreover, these base precursors are susceptible to air or moisture, and are subsequently decomposed to change the photographic properties of the light-sensitive material or impair its storability.

SUMMARY OF THE INVENTION

Thus, an object of the present invention is to provide a heat-developable light-sensitive material containing a base precursor which can provide a high density in a short time and has an improved storage stability.

This object has now been attained according to the present invention by a heat-developable light-sensitive material comprised a support having thereon, at least a layer containing a compound represented by the following general formula (I):

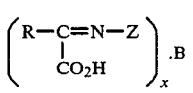

(I)

wherein R represents a hydrogen atom; a substituted or unsubstituted alkyl group, preferably containing from 1 to 10 carbon atoms, for example, a methyl group, a propyl group, a n-hexyl group, etc.; a substituted or unsubstituted cycloalkyl group, preferably containing from 5 to 8 carbon atoms, for example, cyclopentyl group, a cyclohexyl group, etc.; a substituted or unsubstituted alkenyl group, preferably containing from 1 to 5 carbon atoms, for example, a propenyl group, etc.; a substituted or unsubstituted alkynyl group, preferably containing from 2 to 5 carbon atoms, for example, an ethynyl group, a propynyl group, etc.; a substituted or unsubstituted aryl group, preferably containing from 6 to 16 carbon atoms, for example, a phenyl group, a naphthyl group, etc.; a substituted or unsubstituted aralkyl group, preferably containing from 7 to 17 carbon atoms, for example, a benzyl group, a β-phenethyl group, etc.; or a substituted or unsubstituted heterocyclic ring group, preferably a 5-membered or 6-membered heterocyclic ring group, such as a pyrrolyl group, a furyl group, a quinolyl group, a thienyl group, and a pyridyl group.

Examples of substituents of substituted R include a halogen atom, an alkoxy group, an aryloxy group, a sulfonyl group, a cyano group, an acyl group, a sulfamoyl group, a hydroxyl group, an acyloxy group, a carboxyl group, an acylamino group, a carbamoyl group, a sulfonylamino group, a ureido group, and the like.

Z represents

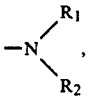

$-OR^3$, $-SR^4$, or $-(CR^6{=}CR^7)_m R^5$ wherein $R^1$ and $R^2$ each represents a hydrogen atom, a substituted or unsubstituted aryl group, a substituted or unsubstituted acyl group, a substituted or unsubstituted alkoxycarbonyl group, a substituted or unsubstituted carbamoyl group, a substituted or unsubstituted alkyl- or arylsulfonyl group, a substituted or unsubstituted sulfamoyl group or a substituted or unsubstituted heterocyclic ring group; or $R^1$ and $R^2$ combine together to form a ring, such as a heterocyclic ring.

Particularly preferably, $R^1$ and $R^2$ each represents a methyl group, an acyl group, a carbamoyl group, or an arylsulfonyl group, or $R^1$ and $R^2$ combine together to form a benzimidazolyl group or a benzotriazolyl group.

$R^3$ represents a hydrogen atom, a substituted or unsubstituted alkyl group, preferably containing from 1 to 10 carbon atoms, a substituted or unsubstituted cycloalkyl group, preferably containing from 5 to 8 carbon atoms, a substituted or unsubstituted alkenyl group, preferably containing from 2 to 5 carbon atoms, a substituted or unsubstituted aryl group, preferably containing from 6 to 16 carbon atoms, a substituted or unsubstituted aralkyl group, preferably containing from 7 to 17 carbon atoms, a substituted or unsubstituted carbamoyl group, a substituted or unsubstituted sulfamoyl group or a substituted or unsubstituted heterocyclic ring group.

Particularly preferably, $R^3$ represents a phenyl group, a benzyl group, a dicyclohexylcarbamoyl group, or a sulfamoyl group.

$R^4$ represents a substituted or unsubstituted alkyl group, preferably containing from 1 to 10 carbon atoms, a substituted or unsubstituted aryl group, preferably containing from 6 to 16 carbon atoms, or a substituted or unsubstituted heterocyclic ring group.

Particularly preferably, $R^4$ represents a benzimidazolyl group or a dicyclohexylcarbamoyl group.

$R^5$ represents a hydroxyl group, a halogen atom, an acylamino group, an alkylsulfonylamino group, or an arylsulfonylamino group.

$R^6$ and $R^7$ each represents a hydrogen atom, a substituted or unsubstituted alkyl group, preferably containing from 1 to 10 carbon atoms, a substituted or unsubstituted alkenyl group, preferably containing from 2 to 5 carbon atoms, a substituted or unsubstituted aryl group, preferably containing from 6 to 16 carbon atoms, or $R^6$ and $R^7$ combine together to form a ring, such as an aromatic ring and a heterocyclic ring. $R^6$ and $R^7$ may, of course, be the same or different.

When n is 2, each of the two $R^6$'s, and each of the two $R^7$'s, respectively, may be different from each other. When n is 2, $R^6$ and $R^7$ in different vinylene chains may combine. Particularly preferably, $R^6$ and $R^7$ combine together, whereby $-(CR^6{=}CR^7)_n-$ forms a phenylene group, and particularly preferably, a 1,4-phenylene group.

n represents an integer or 1 or 2.

B represents an organic base, preferably having a pKa value of not less than 9 and a boiling point of not less than 100° C., and more preferably having a pKa value of not less than 10 and being substantially non-volatile and nonsticky at room temperature (about 0° to 35° C.). Examples of the above preferred base include guanidine compounds, cycloguanidine compounds (for example,

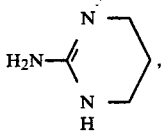

etc.), amidine compounds, cycloamidine compounds (for example,

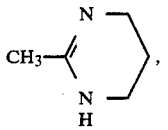

etc.).

Moreover, the base represented by B is preferably hydrophilic, and a base containing less than 10 carbon atoms is used preferably.

x is 1 when B is a base having an acidity of 1, and x is 2 when B is a base having an acidity of 2.

DETAILED DESCRIPTION OF THE INVENTION

Examples of preferable bases represented by B are described in the following.

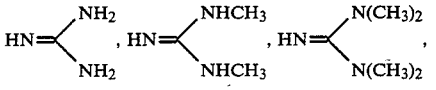

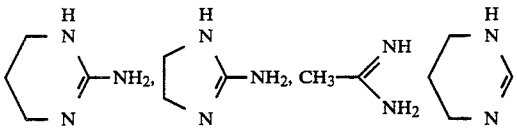

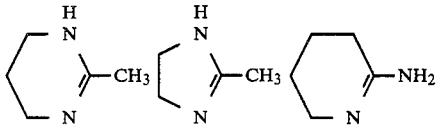

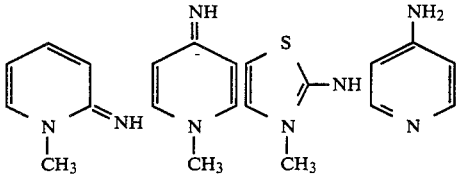

-continued

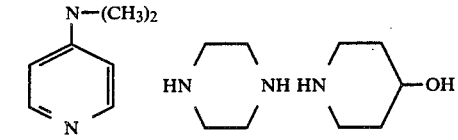

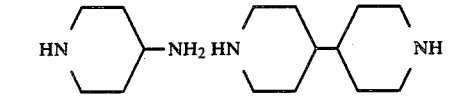

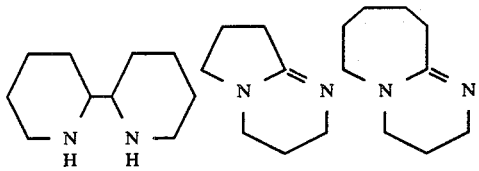

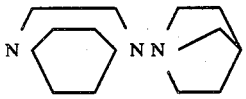

Examples of preferable base precursors used in the present invention are described in the following.

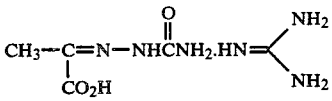

(1)

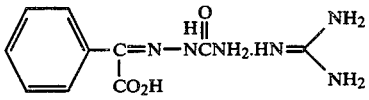

(2)

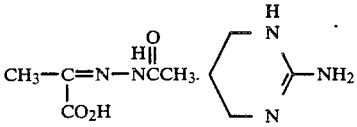

(3)

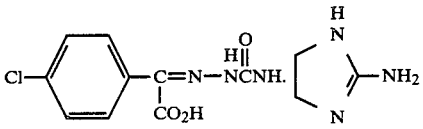

(4)

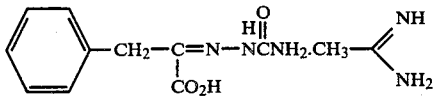

(5)

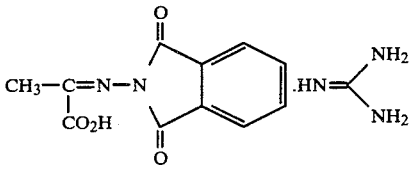

(6)

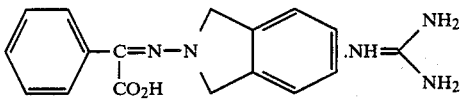

(7)

-continued
(8)
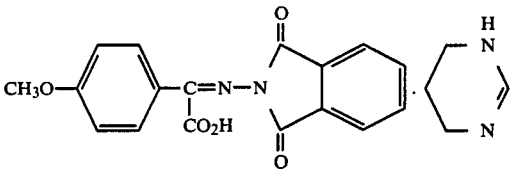
(9)
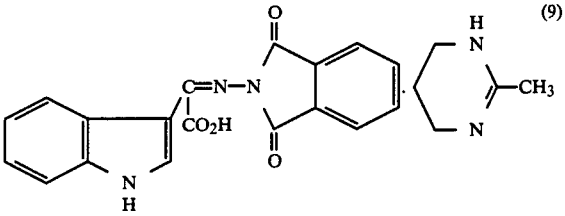
(10)
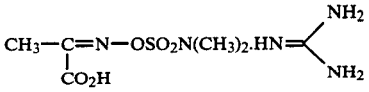
(11)
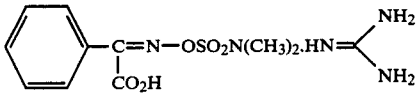
(12)
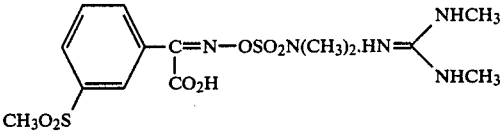
(13)
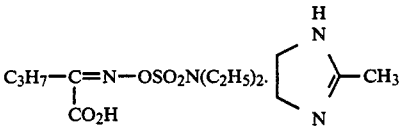
(14)
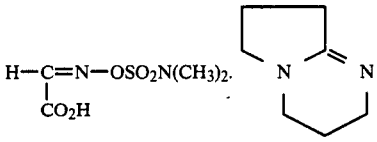
(15)
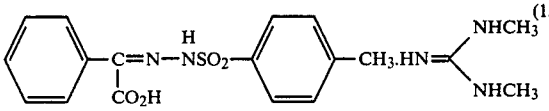
(16)
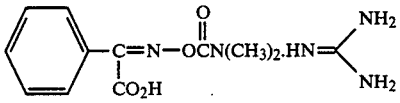
(17)
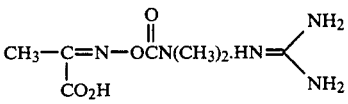
(18)
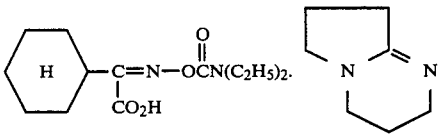
-continued
(19)
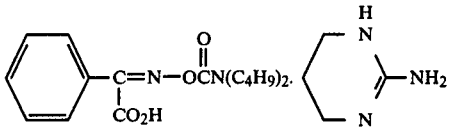
(20)
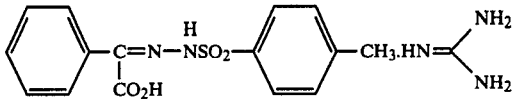
(21)
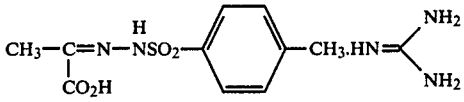
(22)
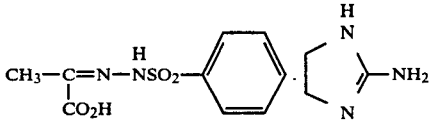
(23)
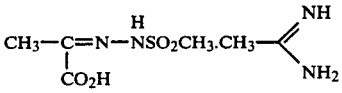
(24)
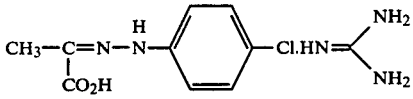
(25)
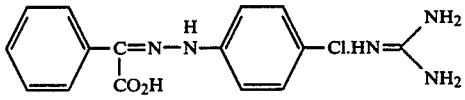
(26)
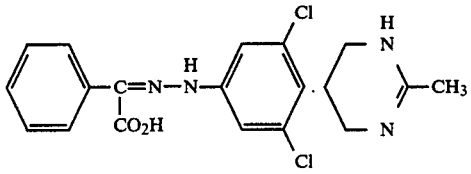
(27)
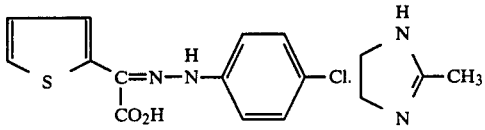
(28)
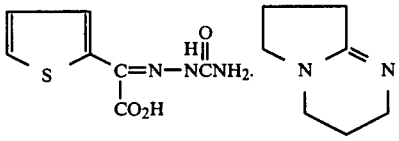
(29)
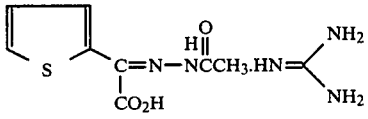
(30)
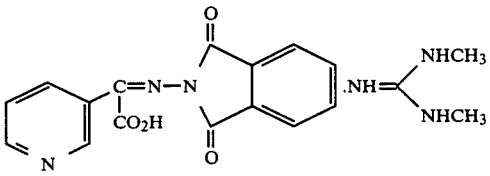

-continued (31)

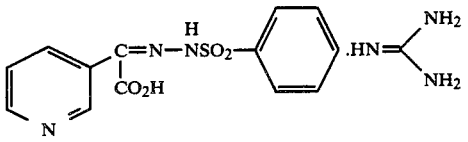

(32)

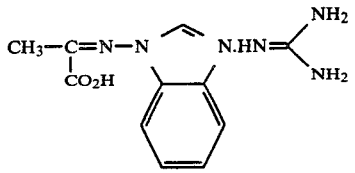

(33)

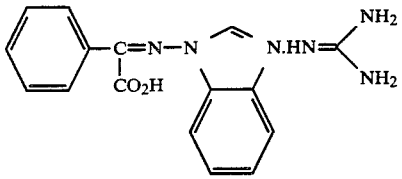

(34)

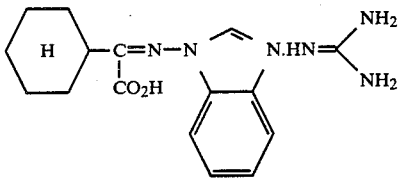

(35)

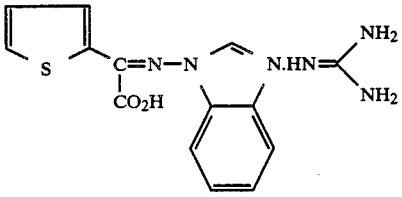

(36)

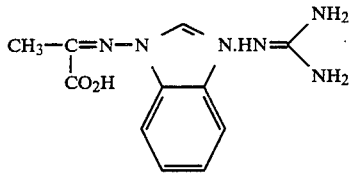

(37)

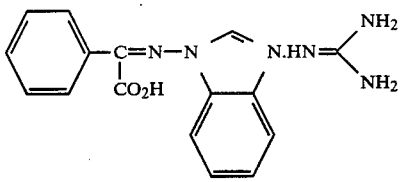

(38)

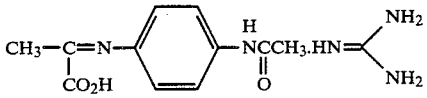

(39)

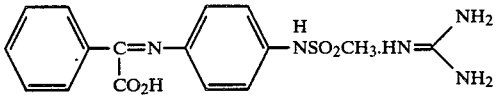

Methods of synthesizing base precursors of the present invention are illustrated by specific examples below.

SYNTHESIS EXAMPLE 1

Synthesis of Base Precursor (1)

22.3 g of hydrochloric acid semicarbazide was dissolved in 100 ml of water, and 13.9 ml of pyruvic acid was added to the solution while stirring. Precipitated crystals were filtered out, washed, and dried to obtain 21 g of 2-carbamoylhydrazonopropionic acid having a melting point of 201° C. (decomposed).

14.5 g of 2-carbamoylhydrazonopropionic acid was dissolved into 100 ml of methanol and 9.0 g of guanidine carbonate was slowly added into the solution. The solution was stirred until guanidine carbonate was dissolved entirely. This solution was added to 600 ml of cool acetonitrile, and the crystals generated were filtered out to obtain 18.9 g of Compound (1) having a melting point of 182° C. (decomposed).

SYNTHESIS EXAMPLE 2

Synthesis of Base Precursor (6)

88 g of pyruvic acid and 150 ml of ethanol were mixed and 80 g of hydrate of hydrazine (min. 80%) was slowly added to this mixture. After 200 ml of acetonitrile was added into the mixture, the crystals generated were filtered out to obtain 85.5 g of 2-hydrazonopropionic acid (m.p. 137° C.) while cooling with ice.

A mixture of 2-hydrazonopropionic acid, 29.6 g of phthalic anhydride and 200 ml of water was stirred for 2 hours at room temperature. The crystals generated were filtered out, washed, and dried to obtain 40.1 g of N-(1-carboxyethylideneamino)phthalimido having a melting point of 192° to 195° C. (decomposed).

9.0 g of guanidine carbonate was slowly added into 200 ml of methanol, then dissolving 23.2 g of N-(1-carboxyethylideneamino)phthalimido therein, and the mixture was stirred until completely dissolved. After removing solvent by distillation, 400 ml of acetone was added, and the crystals generated thereby were filtered out to obtain 20.0 g of Compound (6) having a melting point of 158° to 159° C. (decomposed).

SYNTHESIS EXAMPLE 3

Synthesis of Base Precursor (10)

70 g hydrochloric hydroxylamine was dissolved in 300 ml of water, and 88 g of pyruvic acid was slowly added to the solution. Precipitated crystals were filtered out, washed, and dried, to obtain 92 g of 2-hydroxyiminopropionic acid having a melting point of 181° C. (decomposed).

15.6 g of 2-hydroxyiminopropionic acid, 28.3 ml of dimethylaminosulfonylchloride and 100 ml of acetonitrile were mixed. 20.8 g of triethylamine was added to the mixture. The resulting mixture was heated for 3 hours while refluxing. After the solvent was removed by distillation under reduced pressure, the residue was extracted with chloroform and dried. After removing the chloroform solvent, the residue was mixed with ice water and crystallized. The crystals was filtered out, washed, and dried to obtain 22 g of 2-(N,N-dimethylsulfamoyloxyimino)propionic acid having a melting point of 180° to 182° C. (decomposed).

9.0 g of guanidine carbonate was slowly added into 150 ml of methanol dissolving 21.0 g of 2-(N,N-dimethylsulfamoyloxyimino)propionic acid at a room temperature. The solvent was removed by distillation, but the residue did not crystallize. 26.8 g of residue was obtained.

SYNTHESIS EXAMPLE 4

Synthesis of Base Precursor (20)

A mixture of 23.8 g of benzoylformic acid, 30.6 g of p-toluenesulfonylhydrazide and 300 ml of water was stirred for 2 hours at 60° C. while heating. Precipitated crystals were filtered out, washed, and dried to obtain 46.5 g of 2-phenyl-2-(p-toluenesulfonylhydrazono)acetic acid having a melting point of 179° C. (decomposed).

9.0 g of guanidine carbonate was slowly added to a suspension containing 31.8 g of 2-phenyl-2-(p-toluenesulfonylhydrazono)acetic acid and 150 ml of methanol. After 15 minutes the suspension became a transparent solution. The solvent was removed by distillation under reduced pressure to obtain 37.4 g of Compound (20), which was oily.

SYNTHESIS EXAMPLE 5

Synthesis of Base Precursor (24)

75.7 g of hydrochloric salt of parachlorophenylhydrazine was dissolved into 350 ml of water. 37.2 g of pyruvic acid was added into the solution. After stirring for 30 minutes at 70° C. while heating, and then cooling, precipitated crystals were filtered out, washed, and dried. These crystals were recrystallized from isopropyl acohol to obtain 57 g of 2-(p-chlorophenylhydrazono)-propionic acid having a melting point of 196° to 197° C. (decomposed).

50 ml of an aqueous solution dissolving 15.3 g of guanidine carbonate was slowly added into a mixture of 36.0 g of 2-(p-chlorophenylhydrazono)prpoionic acid and 200 ml of methanol. Precipitated crystals were filtered out, washed, and dried to obtain 33 g of Compound (24) having a melting point of 141° to 143° C. (decomposed).

The base precursors of the present invention show particularly remarkable effects when used together with spectrally sensitized light-sensitive silver halide emulsions. That is, when used together with spectrally sensitized light-sensitive silver halide emulsions, the base precursors greatly raise the image density.

Spectral sensitization is effected by using methine dyes or the like. Dyes to be used for spectral sensitization include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes. In these dyes, any of nuclei ordinarily used as a basic hetero ring nuclei in cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. may be used. These nuclei may be substituted in the carbon atoms.

In the merocyanine dyes or complex merocyanine dyes, 5- or 6-membered hetero ring nuclei such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc. may be used as ketomethylene structure-containing nuclei.

Sensitizing dyes are used suitably in amounts of 0.001 g to 20 g, preferably 0.01 g to 2 g, per 100 g of silver used for preparation of the emulsion.

The base precursors of the present invention may be used in a wide range of amounts, usefully in amounts of 50 wt% or less, more preferably 0.01 wt% to 40 wt%, based on the weight of dried coating of the light-sensitive material.

Additionally, the unit and stratum structure of the light-sensitive material in accordance with the present invention may be arbitrary, and the base precursors may be added to various layers of the light-sensitive material but, where light-sensitive layers and dye-providing substance-containing layers are separately provided, they may be added to these layers.

Further, the precursors may be added to interlayers or protective layers.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* No. 14433, pages 30–32 (April, 1976), ibid., No. 15227, pages 14–15 (December, 1976) and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* No. 16966, pages 54–58 (May, 1978), may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,492, West German Pat. No. 3,215,485, European Pat. No. 66,282, Japanese Patent Application Nos. 28928/83 and 26008/83, etc., can be employed.

Preferred dye providing substances which can be employed in these processes can be represented by the following general formula (CI):

$$(\text{Dye-X})_q\text{Y} \qquad \text{(CI)}$$

wherein Dye represents a dye which becomes mobile when it is released from the molecule of the compound represented by the general formula (CI); X represents a simple bond or a connecting group; Y represents a group which releases Dye in correspondence or countercorrespondence to light-sensitive silver salts having a latent image distributed imagewise, the diffusibility of Dye released being different from that of the compound represented by formula (CI) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Patent Application No. 76,492 can be utilized.

Examples of the connecting group represented by X include —N— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

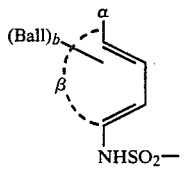

(CII)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of —$OG^{11}$ or —$NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group), Ball represents a ballast group, and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

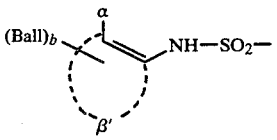

(CIII)

wherein Ball, $\alpha$, and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82, and U.S. Pat. No. 4,053,312.

Further examples of Y suited for this type of compound are those represented by the following formula (CIV):

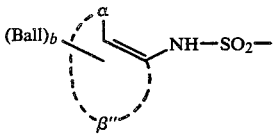

(CIV)

wherein Ball, $\alpha$, and b are the same as defined with formula (CII), and $\beta''$ represents atoms necessary for forming a hetero ring such as a pyrazole ring, a pyridine ring or the like, said hereto ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

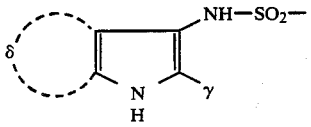

(CV)

wherein $\gamma$ preferably represents hydrogen, a substituted or unsubstituted alkyl, aryl or heterocyclic group, or —CO—$G^{21}$; $G^{21}$ represents —$OG^{22}$, —$SG^{22}$ or

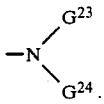

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen atom or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

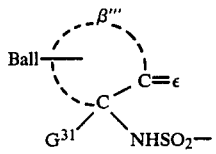

(CVI)

wherein Ball is the same as defined with the formula (CII); $\epsilon$ represents an oxygen atom or $=NG^{32}$ (wherein $G^{32}$ represents hydroxy or an optionally substituted amino group) (examples of $H_2N—G^{32}$ to be used for forming the group of $=NH^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

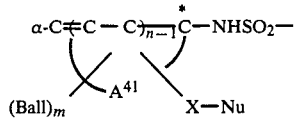

(CVII)

wherein $\alpha$ represents $—OR^{41}$ or $—NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer or 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above-described formula (CII). Specific examples of this type of Y are described in Japanese Patent Application (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

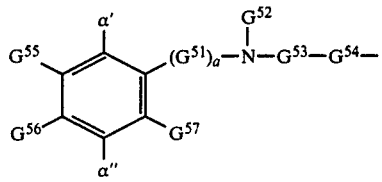

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO—, or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamoyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

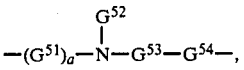

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

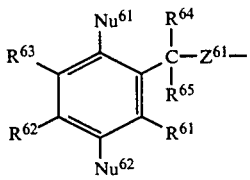

(CIX)

-continued (CX)

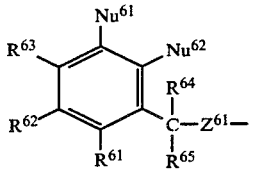

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$, and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above-described compounds immobile. Specific examples of this type of Y are described in Japanese Patent Application (OPI) Nos. 69033/78 and 130927/79.

Further examples of Y suited for this type of compounds are those which are represented by the formula of (CXI):

(CXI)

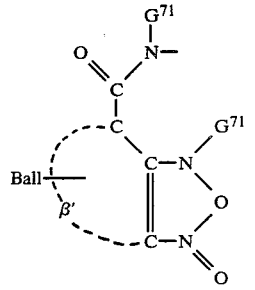

wherein

Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compounds are those represented by the formula (CXII):

(CXII)

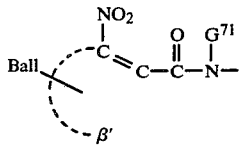

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by the formula (CXIII):

(CXIII)

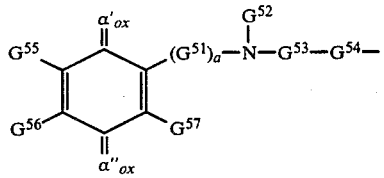

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIVA) and (CXIVB):

(CXIVA)

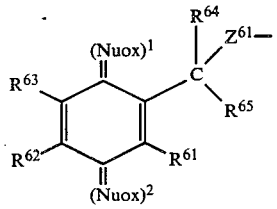

(CXIVB)

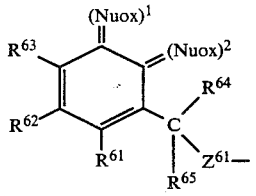

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIVA) and (CXVB) describe electron donors to be used in combination.

As still further different type of compound represented by the general formula (CI), there are illustrated LDA compounds (Linked Donor Acceptor Compounds). These compounds are dye providing nondiffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula of (CXV) (specific examples thereof being described in Japanese Patent Application (OPI) No. 60289/83):

(CXV)

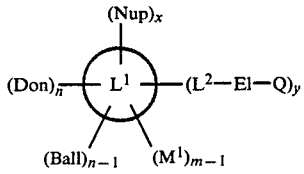

wherein n, x, y, and z each represents 1 or 2; m represents an integer of 1 or more; Don represents a group containing an electron donor or its precursor moiety; $L^1$ represents an organic group linking Nup to $L^2$-El-Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substances which can be used in the present invention are described in the patents cited hereinbefore. Since length prevents illustrating all preferred examples thereof, only a portion thereof is described hereinafter.

The dye-providing substance used in the present invention can be introduced into a layer of the photosensitive material by known methods such as a method as described in U.S. Pat. No. 2,322,027. In this case, an organic solvent having a high boiling point or an organic solvent having a low boiling point as described below can be used. For example, the dye-providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye-providing substance is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol), N-methyl-aminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)-catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos.

13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bis-isothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromo-ethyl-2-thiazolium trichloroacetate, etc., as described in U.S. Pat. No. 4,012,260, compounds having α-sulfonylacetate as an acid part such as bis(2-amino-2-thiazolium)-methylenebis-(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The light-sensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable light-sensitive material used, processing conditions, desired images and various other factors, generally ranges from about 0.001 to 0.1 mole per mol of silver in the light-sensitive material.

The above-described bases or base precursors can be used not only for the acceleration of dye release but also for other purposes such as the control of a pH value.

The above-described various ingredients to constitute a heat developable light-sensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable light-sensitive material can be reduced. Therefore, such distribution of additives is of advantage to some cases.

The heat developable light-sensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photosensitive material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the light-sensitive material and the dye-fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc. which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye-fixng material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the light-sensitive material of the present invention, or example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079, and Japanese Patent Application Nos. 28928/83 (corresponding to U.S. patent application Ser. No. 582,655 filed on Feb. 23, 1984) and U.S. Pat. No. 4,503,137. Methods for the exposure and so on cited in the above described patents can also be employed in the present invention.

According to the present invention, the heat-developable light-sensitive material containing the compound represented by formula (I) can provide an image having a high density in a short period of time. There is no change in the photographic properties thereof even over a long period of time, i.e., the heat-developable light-sensitive material of the present invention has improved storage stability.

Specific examples of the present invention are described below to illustrate the effects of the present invention in more detail.

EXAMPLE 1

Method for Preparing a Silver Iodobromide Emulsion 40 g of gelatin and 26 g of potassium bromide were dissolved into 3000 ml of water. This solution was stirred at 50° C.

200 ml of water containing 34 g of silver nitrate and 200 cc of a solution prepared by dissolving 0.02 g of the below-mentioned Dye I into 300 cc of methanol were added into the above-mentioned gelatin solution over 10 minutes. Then into this solution 100 ml of water containing 3.3 g of potassium iodide was added over 2 minutes.

The thus prepared silver iodobromide emulsion was adjusted in pH, precipitated, and freed of excess salt. It was then adjusted to a pH of 6.0, whereby 400 g of a silver iodobromide emulsion was obtained.

Method For Preparing A Gelatin Dispersion Of A Coupler 5 g of 2-dodecylcarbonyl-naphthol, 0.5 g of succinic acid 2-ethylhexyl ester sulfonic acid sodium salt and 2.5 g of tricresyl phosphate (TCP) were dissolved into 30 ml of ethyl acetate. A mixture of this solution and 100 g of a 10% aqueous solution of gelatin was stirred and dispersed by means of a homogenizer at 10,000 rpm for 10 minutes.

Dye I

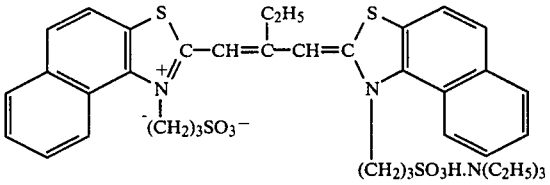

A coating solution having the composition described below was coated on a polyethylene terephthalate film support at a wet layer thickness of 60 μm and dried, whereby the light-sensitive material was prepared.

(a) Silver iodobromide emulsion: 10 g
(b) Gelatin dispersion of the coupler: 3.5 g
(c) Base Precursor (1) of the present invention: 0.25 g
(d) Gelatin (10% aqueous solution): 5 g
(e) 17 ml of aqueous solution containing 0.2 g of 2,6-dichloro-p-aminophenol This light-sensitive material was imagewise exposed by a tungsten lamp at 2,000 lux for 5 seconds. Then, the light-sensitive material was heated uniformly at 150° C. for 20 seconds on a heated block, to obtain a negative cyan color image. The density of the image was measured using a Macbeth transmission densitometer (TD-504) to obtain results of 0.24 as the minimum density and 2.11 as the maximum density. Thus it is understood that the compound of the present invention provides high density images.

EXAMPLE 2

The iodobromide emulsion used in Example 1 and the dispersion of dye providing substance described below were used.

Method for Preparing a Dispersion of a Dye Providing Substance 5 g of the dye providing substance 1) described below, 0.5 g of succinic acid sodium salt as a surface active agent, and 5 g of tricresylphosphate (TCP) were dissolved in 30 ml of ethyl acetate at about 60° C. A mixture of this solution and 100 g of 10% aqueous solution of gelatin was stirred and dispersed by means of a homogenizer at 10,000 rpm for 10 minutes.

A method for preparing a light-sensitive coating solution is described in the following.

(a) Light-sensitive iodobromide emulsion (same as described in Example 1): 25 g
(b) Dispersion of dye providing substance (1): 33 g
(c) 5% aqueous solution of the following compound: 10 ml

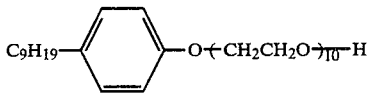

(d) 10% aqueous solution of the following compound: 4 ml $H_2NSO_2N(CH_3)_2$ (e) Base precursor (1) of the present invention: 2.5 g
(f) water: 20 ml A mixture of the above compounds of (a) to (f) was dissolved under heating. Then the solution was coated on a polyethylene terephthalate film support at a wet layer thickness of 30 μm. This coating material was dried and imagewise exposed by a tungsten lamp at 2000 lux for 10 seconds. Then, the coating material was uniformly heated at 150° C. for 20 seconds on a heated block. This coating material was designated as Sample A.

Samples B, C and D were prepared in the analogous manner as above, by adding 1.8 g of guanidine trichloroacetic acid, 2.1 g of guanidine phenylsulfonylacetic acid, and 2.2 g of guanidine salt of 3-sulfamoylphenylsulfonylacetic acid, respectively, in place of Base precursor (1) of the present invention.

A method for preparing an image receiving material containing an image receiving layer is described below.

A 10 wt% solution of poly(acrylate methyl-co-N,N,N-trimethyl-N-vinylbenzyl-ammoniumchloride) (molar ratio of acrylate methyl to N,N,N-trimethyl-N-vinlybenzylammonium chloride of 1/1) was dissolved in 200 ml of water and this aqueous solution was uniformly mixed with 100 g of 10% aqueous solution of lime-treated gelatin. This mixture was uniformly coated at a wet thickness of 90 μm on a paper support laminated with polyethylene containing titanium dioxide dispersed therein. This material was dried to provide image receiving layer.

The image receiving material was soaked in water and superimposed on each of the above heated Light-sensitive Materials A, B, C, and D in such a manner that the silver halide emulsion layers and the image-receiving layers were in contact with each other.

After heating at 80° C. for 6 seconds on the heated block, the image receiving material was separated from the light-sensitive materials to obtain negative magenta color images thereon. The density of the negative image was measured by a Macbeth reflective densitometer (RD-519).

Samples A, B, C, and D were stored at 60° C. for two days and processed in the same manner as the above. The minimum density and the maximum density were measured.

These results were shown in Table 1.

TABLE 1

| Sample No. | Fresh Dmax | Fresh Dmin | After 2 days D'max | After 2 days D'min |
|---|---|---|---|---|
| A (Present Invention) | 2.07 | 0.20 | 2.04 | 0.25 |
| B (Comparison) | 2.14 | 0.58 | * | * |
| C (Comparison) | 1.28 | 0.16 | 1.33 | 0.20 |
| D (Comparison) | 1.45 | 0.15 | 1.49 | 0.27 |

*Fog occurred throughout the surface of the receiving material.

It is clear from Table 1 that the base precursor of the present invention gives a high maximum density, a low minimum density, and a good storage stability.

EXAMPLE 3

The procedure of Example 2 was repeated, except that the base precursors described below were used. The results obtained are shown in Table 2.

TABLE 2

| Sample No. | Base precursor and amount added | Fresh Dmax | Fresh Dmin | After 2 days D'max | After 2 days D'min |
|---|---|---|---|---|---|
| E | Compound (6) 3.7 g | 2.04 | 0.25 | 2.04 | 0.28 |
| F | Compound (10) 3.1 g | 2.16 | 0.21 | 2.11 | 0.27 |
| G | Compound (20) 4.2 g | 2.08 | 0.20 | 2.01 | 0.30 |
| H | Compound (24) 3.0 g | 1.98 | 0.13 | 1.95 | 0.15 |

It is understood from Table 2 that the base precursor of the present invention gives a high maximum density, a low minimum density, and a good storage stability.

EXAMPLE 4

An example in which an organic silver salt oxidizing agent was used is described below.

Method for Preparing a Silver Benzotriazole Emulsion

Gelatin (28 g) and benzotriazole (13.2 g) were dissolved in water (3000 ml). The resulting solution was stirred at 40° C. A solution containing silver nitrate (17 g) dissolved in water (100 ml) was added over 2 minutes.

The resulting benzotriazole silver emulsion was adjusted in pH to cause precipitation and the excess salt was removed out. The emulsion was adjusted to a pH of 6.0, thereby providing a silver benzotriazole emulsion (yield: 400 g).

Using this silver benzotriazole emulsion, a light-sensitive coating composition was prepared from the following.

(a) Silver iodobromide emulsion (as described in Example 1): 20 g
(b) Silver benzotriazole emulsion: 10 g
(c) Dispersion of the dye providing substance (as described in Example 2): 33 g
(d) 5% Aqueous solution of the following Compound

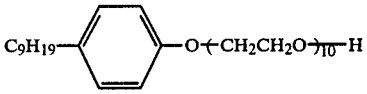

(e) 10% Aqueous solution of the following compound: 4 ml $H_2NSO_2N(CH_3)_2$ (f) Base precursor (1) of the present invention: 2.7 g
(g) Gelatin dispersion of Acid precursor (described below): 8 ml
(h) Water: 12 ml Gelatin dispersion of Acid precursor described in (g) was prepared as below.

The compound as described below (10 g) was added to a 1 wt% aqueous solution of gelatin (100 g) and ground by use of glass beads (100 g) having a mean grain diameter of about 0.6 mm in a mill for 10 minutes. The glass beads were filtered out to obtain the gelatin dispersion of Acid precursor.

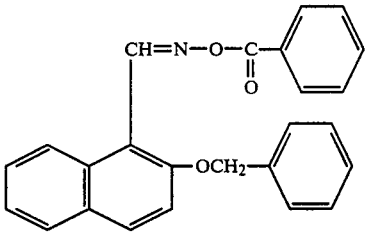

After mixing (a) to (g) described above, samples were prepared and processed in the same way as in Example 2. The result is shown below.

TABLE 3

| | Sample | Dmax | Dmin |
|---|---|---|---|
| (A') | containing Base precursor (24) (the present invention) | 2.13 | 0.27 |
| (B') | containing guanidine trichloroacetic acid (control) | 2.33 | 0.61 |
| (C') | containing guanidine salt of phenylsulfonyl acetic acid (control) | 1.47 | 0.19 |

It is further understood from Table 3 that the base precursor of the present invention gives a high maximum density and a low minimum density.

Samples A', B' and C' were stored at 60° C. for two days and processed in the same manner as above. The minimum density and the maximum density of Sample A' were 0.36 and 2.13, respectively, and those of Sample C' were 0.20 and 1.52, respectively, but fog occurred throughout the surface of Sample B'. It is thus understood that Sample A' according to the present invention has improved storage stability.

EXAMPLE 5

Method for Preparing a Silver Benzotriazole Emulsion Containing Light-Sensitive Silver Bromide Benzotriazole (6.5 g) of gelatin (10 g) were dissolved in water (1000 ml). The resulting solution was stirred at 50° C. A solution containing silver nitrate (8.5 g) dissolved in water (100 ml) was added into the above solution over two minutes. To this solution a solution containing potassium bromide (1.2 g) dissolved in water (50 ml) was added over two minutes. The prepared emulsion was adjusted in pH to cause precipitation and the excess salt was removed out. The emulsion was adjusted to a pH of 6.0, thereby providing 200 g of the emulsion.

Method for Preparing a Gelatin Dispersion of a Dye-Providing Substance

Dye providing substance (CI-16) (10 g) having the formula below,

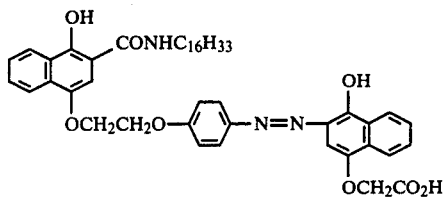

succinic acid-2-ethyl-hexylestersulfonic acid sodium salt (0.5 g) as a surface active agent and tricresyl phosphate (TCP) (4 g) were dissolved in cyclohexanone (20 ml) at 60° C. to make a uniform solution. A mixture of the resulting solution and a 10 wt% aqueous solution (100 g) of lime-processed gelatin was dispersed by means of a homogenizer at 10,000 rpm for 10 minutes.

A method for preparing a light-sensitive coating material is described below.

(a) Silver benzotriazole emulsion containing light-sensitive silver bromide: 10 g
(b) Dispersion of dye-providing substance: 3.5 g
(c) Base precursor (1) of the present invention: 0.25 g
(d) Gelatin (10% aqueous solution): 5 g
(e) Methanol solution containing 2,6-dichloro-4-aminophenol (200 ml): 4 ml Components (a) to (e) above were mixed and melted. The resulting solution was coated at a wet layer thickness of 30 μm on a polyethylene terephthalate film having a thickness of 180 μm. After drying, this coating sample was imagewise exposed at 2,000 lux for 10 seconds by a tungsten lamp. Then this sample was uniformly heated at 150° C. for 20 seconds on a heated block.

Using the image receiving material prepared in Example 2 the heated sample was processed in the same manner as Example 2 to obtain a negative magenta color image on the image receiving material. The maximum density and the minimum density of this negative image were 2.10 and 0.21, respectively, measuring by means of a Macbeth reflective densitometer (RD-519).

It is thus understood that the compound of this present invention shows a good effect.

EXAMPLE 6

Method for Preparing a Gelatin Dispersion of the Below Dye-Providing Substance (CI-17)

Dye-providing substance (5 g)

(CI-17)

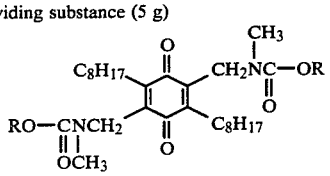

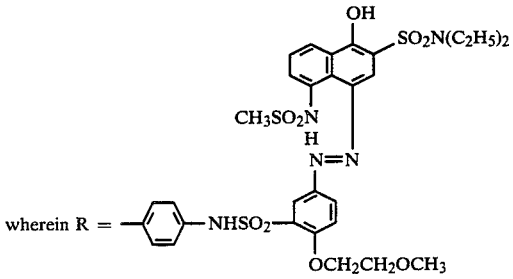

Electron donative substannce (4 g)

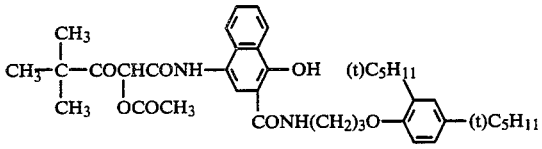

succinic acid-2-ethyl-hexylestersulfonic acid sodium salt (0.5 g) and tricresyl phosphate (TCP) (10 g) were dissolved into cyclohexanone (20 ml) at about 60° C. A mixture of the resulting solution and 10% aqueous solution (100 g) of gelatin was dispersed by means of a homogenizer at 10,000 rpm for 10 minutes.

A method for preparing a light-sensitive coating material is described below.

(a) Silver benzotriazole emulsion containing light-sensitive silver bromide (described in Example 5): 10 g (b) Dispersion of dye providing substance (prepared in this Example): 3.5 g (c) Base precursor (1) of the present invention: 0.37 g (d) 5% aqueous solution of the compound: 1.5 ml

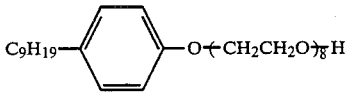

Water (4 ml) was added into the mixture of (a) to (d). After melting, this soluttion was coated at a wet layer thickness of 30 μm on a polyethylene terephthalate film. This coating material was dried to provide a light-sensitive material.

This light-sensitive material was imagewise exposed at 2,000 lux for 10 seconds by a tungsten lamp. Then the light-sensitive material was uniformly heated at 140° C. for 40 seconds on a heated block.

The image receiving material described in Example 2 was soaked in water and superimposed on the above heated light-sensitive material in such a manner that the silver halide emulsion layer and the image receiving layer were in contact with each other. A positive magenta color image was obtained on the image receiving material. A density of this positive image was measured by green light by use of a Macbeth reflective densitometer (RD-519) to obtain a maximum density of 2.19 and a minimum density of 0.22.

It is thus further understood that the base precursor of the present invention is effective.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon a silver halide emulsion layer, a reducing agent present in said emulsion layer or in a separate layer, wherein at least one layer contains a base precursor compound represented by formula (I)

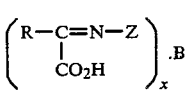

(I)

wherein R represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aryl group, a substituted or unsubstituted heterocyclic ring group and a substituted or unsubstituted aralkyl group;

Z represents

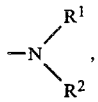

$-OR_3$, $-SR_4$, or $-(CR^6{=}CR^7)_n R^5$ wherein $R^1$ and $R^2$ each represents a hydrogen atom, a substituted or unsubstituted aryl group, a substituted or unsubstituted acyl group, a substituted or unsubstituted alkoxycarbonyl group, a substituted or unsubstituted carbamoyl group, a substituted or unsubstituted alkylsulfonyl group, a substituted or unsubstituted arylsulfonyl group, a substituted or unsubstituted sulfamoyl group or a substituted or unsubstituted heterocyclic ring group; or $R^1$ and $R^2$ combine together to form a ring;

$R^3$ represents a hydrogen atom, a substituted or unsubstituted alkyl group, a substituted or unsubstituted cycloalkyl group, a substituted or unsubstituted alkenyl group, a substituted or unsubstituted aryl group, a substituted or unsubstituted aralkyl group, a substituted carbamoyl group, a substituted or unsubstituted sulfamoyl group or a substituted or unsubstituted heterocyclic ring group.

$R^4$ represents a substituted or unsubstituted alkyl group, a substituted or unsubstituted aryl group, or a substituted or unsubstituted heterocyclic ring group; p1 $R^5$ represents a hydroxyl group, a substituted or unsubstituted acylamino group, a substituted or unsubstituted alkylsulfonylamino group, or a substituted or unsubstituted arylsulfonylamino group;

$R^6$ and $R^7$, respectively, represent a hydrogen atom, a substituted or unsubstituted alkyl group, a substituted or unsubstituted alkenyl group, or a substituted or unsubstituted aryl group, or $R^6$ and $R^7$ combine together to form a ring;

n represents an integer or 1 or 2

B represents an organic base;

x represents an integer of 1 when B is a base having acidity of 1, and x represents an integer of 2 when B is a base having an acidity of 2.

2. A heat-developable light-sensitive material as in claim 1, wherein R represents a hydrogen atom, a substituted or unsubstituted alkyl group containing from 1 to 10 carbon atoms, a substituted or unsubstituted cycloalkyl group containing from 5 to 8 carbon atoms, a substituted or unsubstituted alkenyl group containing from 1 to 5 carbon atoms, a substituted or unsubstituted alkynyl group containing from 2 to 5 carbon atoms, a substituted or unsubstituted aryl group containing from 6 to 16 carbon atoms, a substituted or unsubstituted aralkyl group containing from 7 to 17 carbon atoms, or a substituted or unsubstituted 5-membered or 6-membered heterocyclic ring group;

Z represents

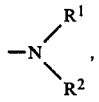

$-OR^3$, $-SR^4$, or $-(CR^6{=}CR^7)_n R^5$ wherein $R^1$ and $R^2$ each represents a methyl group, an acyl group, a carbamoyl group, or an arylsulfonyl group, or $R^1$ and $R^2$ combine together to form a benzimidazolyl group or a benzotriazolyl group;

$R^3$ represents a hydrogen atom, a substituted or unsubstituted alkyl group containing from 1 to 10 carbon atoms, a substituted or unsubstituted cycloalkyl group containing from 5 to 8 carbon atoms, a substituted or unsubstituted alkenyl group containing from 2 to 5 carbon atoms, a substituted or unsubstituted aryl group containing from 6 to 16 carbon atoms, a substituted or unsubstituted aralkyl group containing from 7 to 17 carbon atoms, a substituted or unsubstituted carbamoyl group, a substituted or unsubstituted sulfamoyl group, or a substituted or unsubstituted heterocyclic ring group;

$R^4$ represents a substituted or unsubstituted alkyl group containing from 1 to 10 carbon atoms, a substituted or unsubstituted aryl group containing from 6 to 16 carbon atoms, or a substituted or unsubstituted heterocyclic ring group;

$R^6$ and $R^7$ each represents a hydrogen atom, a substituted or unsubstituted alkyl group containing from 1 to 10 carbon atoms, a substituted or unsubstituted alkenyl group containing from 2 to 5 carbon atoms, a substituted or unsubstituted aryl group containing from 6 to 16 carbon atoms, or $R^6$ and $R^7$ combine together to form a ring;

B represents an organic base having a pKa value of not less than 9 and a boiling point of not less than 100° C.

3. A heat-developable light-sensitive material as in claim 2, wherein $R^3$ represents a phenyl group, a benzyl group, a dicyclohexylcarbamoyl group, or a sulfamoyl group;

$R^4$ represents a benzimidazolyl group or a dicyclohexylcarbamoyl group.

4. A heat-developable light-sensitive material as in claim 2, wherein B represents an organic base having a pKa value of not less than 10 and is substantially non-volatile and non-sticky at room temperature.

5. A heat-developable light-sensitive material as in claim 3, wherein B represents an organic base having a pKa value of not less than 10 and is substantially non-volatile and non-sticky at room temperature.

* * * * *